US010638825B2

(12) United States Patent
Legastelois et al.

(10) Patent No.: US 10,638,825 B2
(45) Date of Patent: May 5, 2020

(54) COMPRESSIBLE DISPENSER OF A LIQUID PRODUCT, IN PARTICULAR A COSMETIC LIQUID PRODUCT SUCH AS A CREAM

(71) Applicant: CHANEL PARFUMS BEAUTE, Neuilly-sur-Seine (FR)

(72) Inventors: Sylvie Legastelois, Asnières-sur-Seine (FR); Olivier Perrin, Châtillon (FR); Nicolas Castex, Colombes (FR); Nicolas Mathieu, Les Lilas (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 0 days.

(21) Appl. No.: 16/077,081

(22) PCT Filed: Feb. 10, 2017

(86) PCT No.: PCT/EP2017/053056
§ 371 (c)(1),
(2) Date: Aug. 10, 2018

(87) PCT Pub. No.: WO2017/137592
PCT Pub. Date: Aug. 17, 2017

(65) Prior Publication Data

US 2019/0038001 A1 Feb. 7, 2019

(30) Foreign Application Priority Data

Feb. 12, 2016 (FR) ..... 16 51124

(51) Int. Cl.
*A45D 37/00* (2006.01)
*A45D 34/00* (2006.01)

(52) U.S. Cl.
CPC ..... *A45D 34/00* (2013.01); *A45D 2034/007* (2013.01)

(58) Field of Classification Search
CPC ..... B65D 83/0055; B65D 47/2018; B65D 47/2031; B67D 7/0255; B05B 11/0072
See application file for complete search history.

(56) References Cited

U.S. PATENT DOCUMENTS 3,240,399 A * 3/1966 Frandeen ..... B05B 11/047 222/211
3,366,284 A * 1/1968 Marona ..... G01F 11/082 222/211

(Continued)

OTHER PUBLICATIONS

International Search Report and Written Opinion in corresponding International Patent Application No. PCT/EP2017/053056, dated Mar. 13, 2017. 14 pages.

(Continued)

*Primary Examiner* — Paul R Durand
*Assistant Examiner* — Randall A Gruby
(74) *Attorney, Agent, or Firm* — Leason Ellis LLP

(57) ABSTRACT

The present invention relates to a compressible dispenser of a liquid product, in particular a cosmetic liquid product such as a cream, which includes a resiliently compressible body, a member for dispensing said liquid product having an outlet opening for the liquid, a cap having a wall, attachment means intended for ensuring the removable attachment of said cap on said body, and which includes a cover covering the distribution member. The outer peripheral surface is flush with said outlet opening, and the wall of the cap and the wall of the body have outer surfaces that are flush at the upper edges thereof. The cap and the body are portions that complement one another, with a continuously convex shape, said protection cover having a shape identical to that of the wall of the cap, but reduced by at least the thickness of the wall of said cap.

7 Claims, 3 Drawing Sheets

(56) References Cited

U.S. PATENT DOCUMENTS

Figure 1:
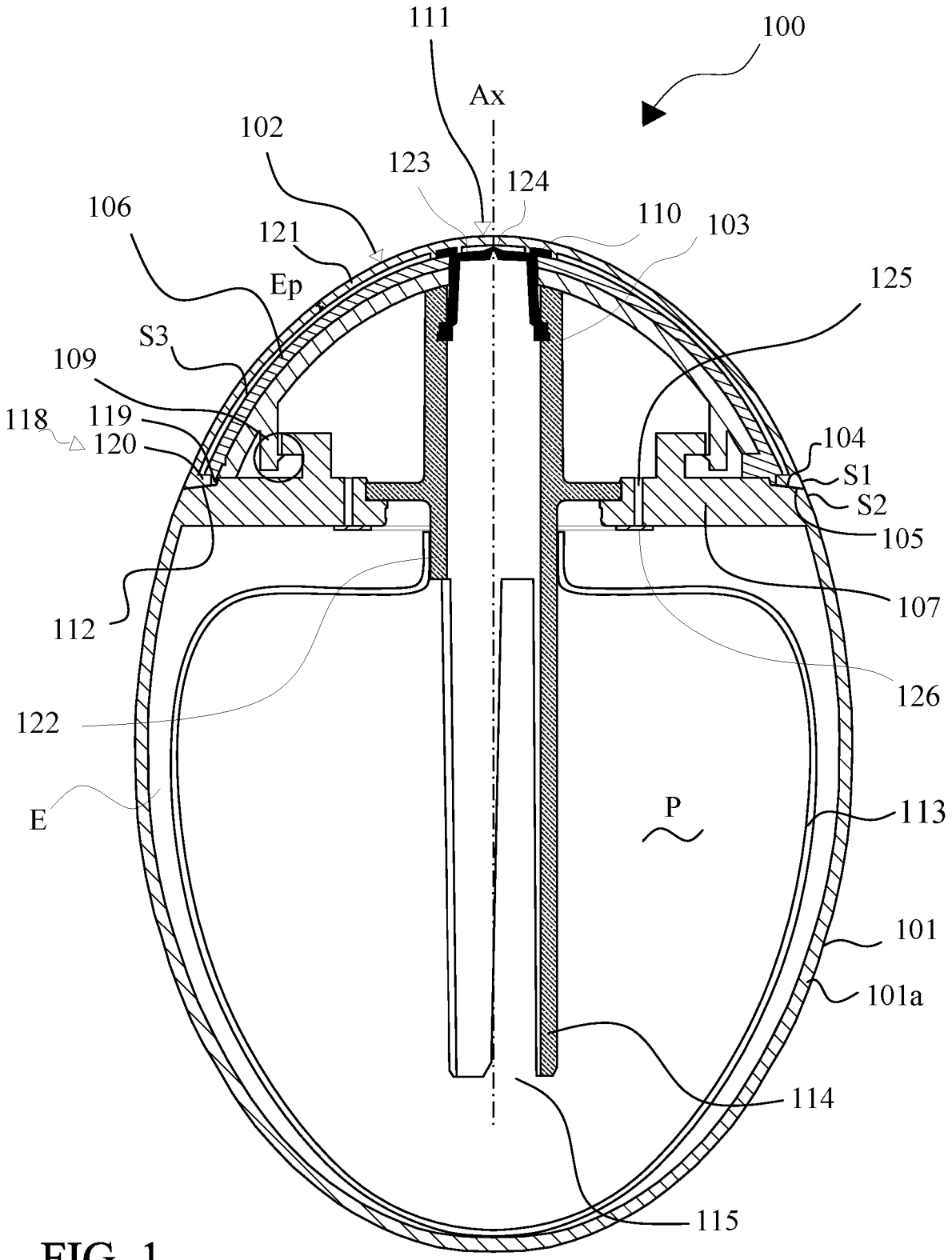

| | | | | | |
|---|---|---|---|---|---|
| D230,954 | S | * | 3/1974 | Gregorietti | D9/504 |
| 4,798,311 | A | * | 1/1989 | Workum | B05B 11/0029 222/131 |
| 5,108,007 | A | * | 4/1992 | Smith | B05B 11/0072 222/209 |
| D349,057 | S | * | 7/1994 | Farce | D9/523 |
| D382,803 | S | * | 8/1997 | Gavin | D9/526 |
| D438,459 | S | * | 3/2001 | Holthaus | D9/728 |
| D463,744 | S | * | 10/2002 | Brozell | D9/449 |
| D493,576 | S | * | 7/2004 | Ward | D28/66 |
| D650,686 | S | * | 12/2011 | de Cleir | D9/529 |
| D651,903 | S | * | 1/2012 | Teller | D9/521 |
| 8,464,908 | B1 | * | 6/2013 | Tabor | B65D 51/1644 222/105 |
| 8,603,557 | B2 | * | 12/2013 | de Cleir | A23L 2/68 426/115 |
| D724,383 | S | * | 3/2015 | May | D7/510 |
| 9,637,272 | B2 | * | 5/2017 | Albaum | B65D 47/2031 |
| 9,833,799 | B2 | * | 12/2017 | Minnette | B05B 11/047 |
| 9,834,363 | B2 | * | 12/2017 | De Cleir | B65D 1/04 |
| 2004/0074924 | A1 | * | 4/2004 | Kuhn | B65D 47/2081 222/211 |
| 2012/0211526 | A1 | * | 8/2012 | Dupuis | B65D 23/0878 222/206 |
| 2012/0237281 | A1 | | 9/2012 | Apodaca et al. | |

OTHER PUBLICATIONS

International Preliminary Report on Patentability in corresponding International Patent Application No. PCT/EP2017/053056, dated Aug. 14, 2018. 6 pages.

* cited by examiner

FIG. 2
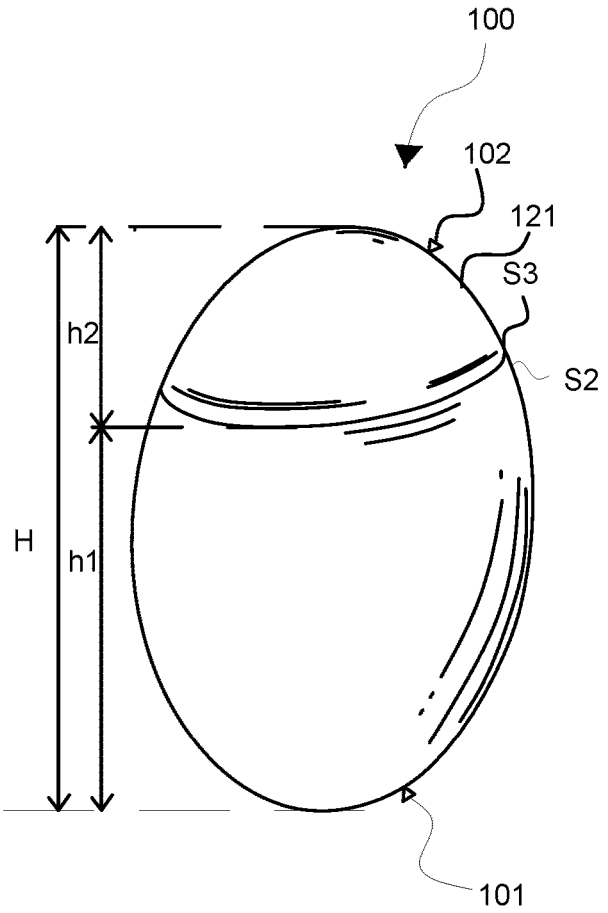
FIG. 3
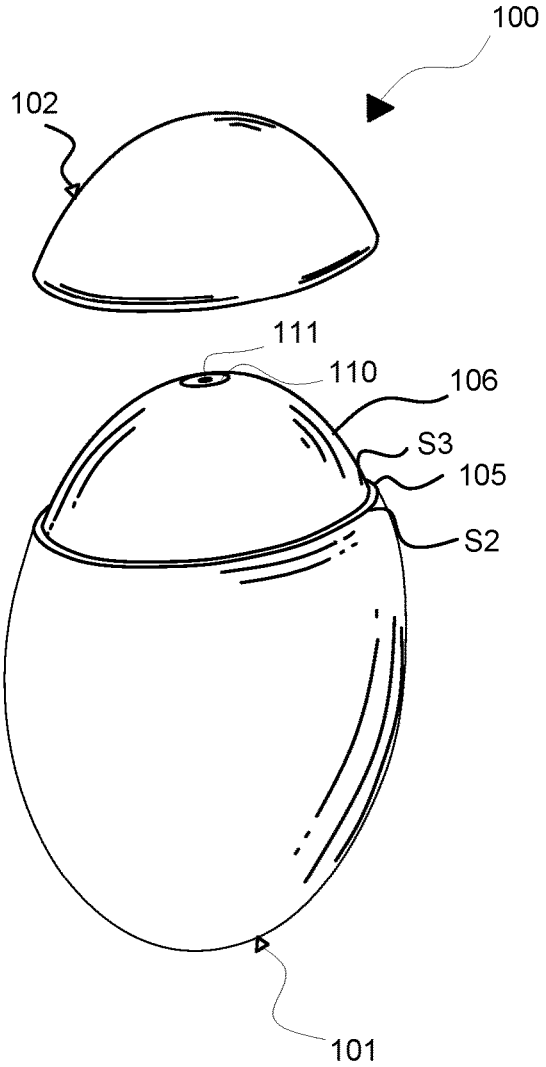
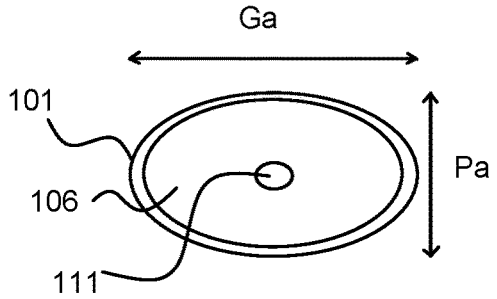
FIG. 4

COMPRESSIBLE DISPENSER OF A LIQUID PRODUCT, IN PARTICULAR A COSMETIC LIQUID PRODUCT SUCH AS A CREAM

CROSS-REFERENCE TO RELATED PATENT APPLICATIONS

This application is a U.S. National Stage Application under 35 U.S.C. § 371 of International Patent Application No. PCT/EP2017/053056, filed Feb. 10, 2017, which claims the benefit of priority under 35 U.S.C. Section 119(e) of French Patent Application number FR 1651124 filed Feb. 12, 2016, both of which are incorporated by reference in their entireties. The International Application was published on Aug. 17, 2017, as International Publication No. WO 2017/137592 A1.

The present invention relates to a resiliently compressible dispenser of a liquid product, in particular a cosmetic liquid product such as a cream.

Compressible-type dispensers are typically those suitable for delivering a liquid product by the action of manual pressure applied to the walls thereof. Said compressible dispensers may be of the type where the liquid product contained is not in contact with the air when being dispensed, which helps ensure the stability and preservation of the product.

This type of dispenser is intended for daily use, sometimes even for use multiple times a day. Said dispenser is often carried by the user, for example in a pocket or handbag. In these circumstances, accidental seepage should be prevented. Provision must therefore be made for a means of protection, such as a cap. However, this type of protection means provided must not be to the detriment of the aesthetic appeal or use of the product. It is therefore indispensable, on the one hand, for the cap not to be such as to become detached from the body at the slightest pressure and, on the other hand, for the cap not to be attached by means requiring too much force or having too many constraints to remove said cap manually.

Moreover, a compressible dispenser should be easily manipulated and not be bulky. It must be possible for said compressible dispenser to be held in one hand and pressed by the same hand. It should also have the best possible functionalities while preserving the aesthetic characteristics expected in the field of cosmetics.

Accordingly, the invention relates to a resiliently compressible dispenser of a liquid product of the type comprising a resiliently compressible body, a dispensing device of said liquid product having an outlet aperture for the liquid, a cap with a wall, and attachment means intended to attach said cap removably to said body. According to the invention, the dispenser is characterized in that it comprises a cover covering the dispensing device, the outer peripheral surface of which is flush with said outlet aperture, in that the wall of the cap and the wall of the body have outer surfaces that are flush at the upper edges thereof, and in that the cap and the body are portions, complementary to one another, and continuously convex in form, said protection cover having a shape identical to that of the wall of the cap, but smaller by at least the thickness of the wall of said cap.

The characteristics of a compressible dispenser according to the invention confer thereon a form and appearance without edges or projecting portions thus allowing said compressible dispenser to be held in one hand and easily manipulated whether the cap is present or whether it has been removed. Grip is thereby improved and made more secure by the continuously convex form which molds to the palm of the hand. Moreover, there is no edge to impede the movement of the dispenser in the hollow of the hand. The friction surface of the dispenser against the palm of the hand permits the rotation thereof and hence makes said dispenser easier to use, in particular the compression of the resiliently compressible body.

The cover both helps protect the dispensing device and helps preserve the shape of the dispenser with the cap on. As the cover is a reduction of the cap, or homothety, when said cap is removed, the dispenser has a shape reminiscent of the continuously convex form thereof when the cap is in place.

Advantageously, the dispenser according to the invention comprises a flexible pouch which is arranged inside said resiliently compressible body and which contains the liquid product, the interior of the flexible pouch being in direct communication with the outlet aperture of the liquid.

Also advantageously, the attachment means are such that the cover has on its outer peripheral surface hollow motifs complementary to motifs in relief provided on the inner peripheral surface of the wall of the cap.

Preferably, the upper edges of said cap and the upper edges of said resiliently compressible body are in contact with one another when said cap is attached to said body.

Advantageously, the dispensing device is in the form of a plunger tube, one end of which extends towards the bottom of the flexible pouch and the other end of which comprises a nozzle provided with a slit creating the outlet aperture.

Also advantageously, the resiliently compressible body has a throat through which one or more openings are arranged which open into a space between the resiliently compressible body and the flexible pouch, a washer acting as a shutter being provided on said or each opening to prevent the air contained in said space from escaping when the user applies manual pressure to said body.

Also advantageously, the dispenser according to the invention has an ellipsoidal shape, an ovoid shape, a flattened ellipsoidal or a flattened ovoid shape.

Figure 5:
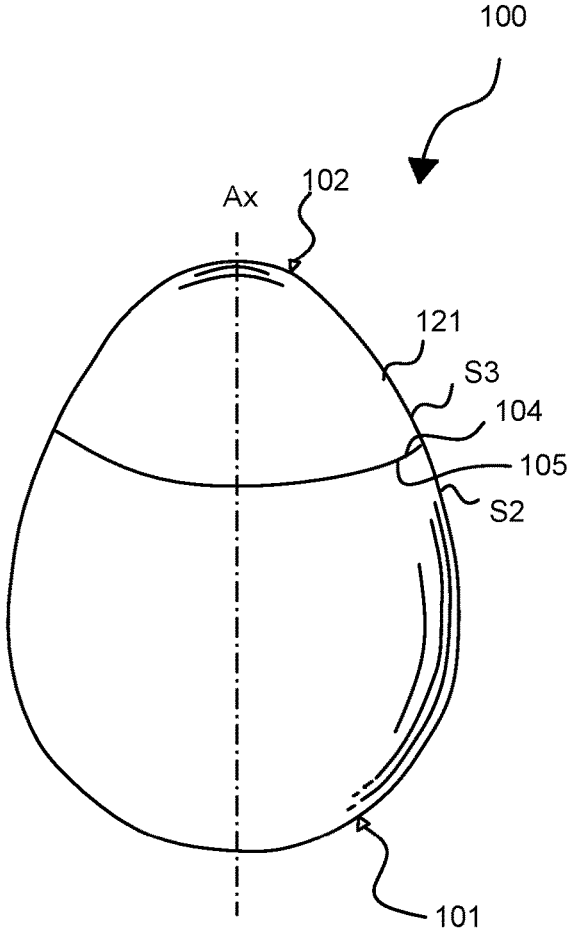
Figure 6:
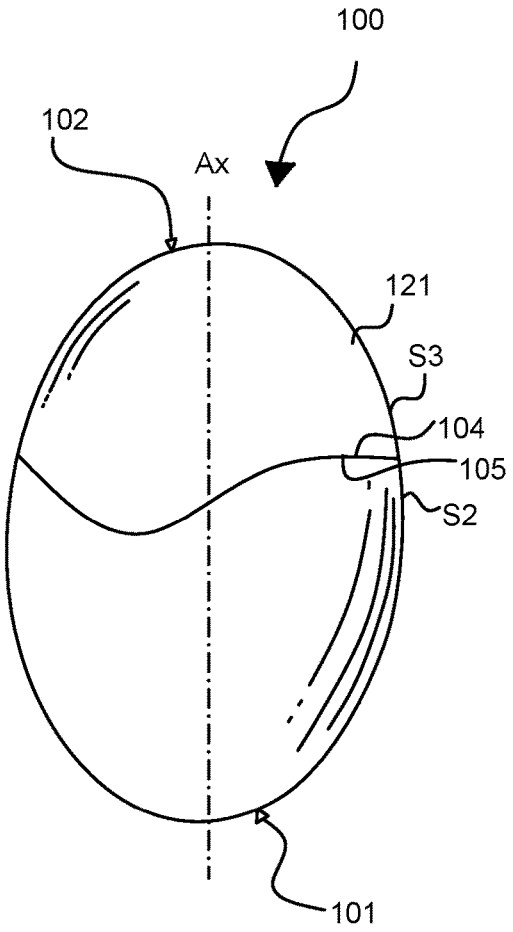

The above-mentioned characteristics of the invention, and others, will appear more clearly on reading the following description of an embodiment, said description being given in relation to the accompanying drawings, in which:

FIG. 1 is a view in cross section of a compressible dispenser according to a first embodiment of the invention and, FIGS. 2 and 3 are perspective views of a compressible dispenser according to the first embodiment of the invention, FIG. 4 is a view from above of a compressible dispenser without its cap according to the first embodiment of the invention, FIG. 5 is a perspective view of a compressible dispenser according to a second embodiment of the invention, FIG. 6 is a perspective view of a compressible dispenser according to a third embodiment of the invention.

In the present invention, "upper edges" means the edges farthest from the bottom of the resiliently compressible body, of the cover, of the cap or of any other element that may compose the dispenser according to the invention.

"Continuously convex form" means a form which is seen as rounded from an external reference point, in other words, from outside the dispenser according to the invention.

A compressible dispenser 100 of a liquid product according to the invention, of the cosmetic liquid product type such as a cream, as shown in FIGS. 1 to 3, comprises a resiliently compressible flexible body 101, a cap 102 with a wall 121, and a dispensing device 114 for dispensing a liquid product P contained in the resiliently compressible body 101.

When the cap 102 is attached to the resiliently compressible body 101, the dispenser 100 has a continuously convex form (FIGS. 1 and 2). The cap 102 and the resiliently compressible body 101 are portions, complementary to one another, of said continuously convex form. The respective outer surfaces S1 and S2, of the wall 121 of the cap 102 and of the wall 101*a* of the resiliently compressible body 101, are flush at the upper edges thereof 104, 105.

In the embodiment described in connection with FIGS. 1 to 3, the dispenser 100 provided with a cap 102 is in the form of a flattened ellipsoid, resembling a pebble in shape. However, other continuously convex forms are envisaged within the scope of the invention, such as an ovoid shape (FIG. 5).

Moreover, in the embodiment described in connection with FIGS. 1 to 5, the upper edges 104, 105 of the cap 102 and of the resiliently compressible body 101 are contained in planes perpendicular to the longitudinal axis Ax of the dispenser 100. However, in variants of the invention, such as the one shown in connection with FIG. 6, the respective upper edges of the cap 102 and of the resiliently compressible body 101 may take any form. In such a variant, however, the continuously convex form of the dispenser 100 is retained.

The dispenser 100 advantageously has dimensions such that said dispenser can be held against the palm of an adult hand. For example, in the embodiment described in connection with FIG. 2, said dispenser has a total height H of between 75 and 100 mm, preferably between 80 and 90 mm. The height h1 of the resiliently compressible body 101 is between 55 and 75 mm, preferably between 60 and 70 mm; the height h2 of the cap 102 is between 15 and 25 mm, preferably between 20 and 25 mm. Seen from above (FIG. 4), the large axis Ga of the ellipsoid-shaped dispenser 100 is between 50 and 65 mm, preferably between 60 and 65 mm; the small axis Pa is between 30 and 45 mm, preferably between 35 and 40 mm. Seen in the plane of the large axis face Ga (plane of FIG. 1), the contour of the dispenser is formed by a succession of arcs of circles of which the radius of curvature increases from a value of about 30 mm at the base of the dispenser to a value of about 60 mm up to the height of the large axis Ga, then decreases from a value of about 100 mm to a value of about 20 mm at the apex of the cap. Seen in the perpendicular plane of the small axis face Pa, the radius of curvature rises from a value of about 16 mm to a value of about 75 mm up to the height of the small axis Pa then falls from a value of about 95 mm to a value of about 9 mm at the apex of the cap. These values are however an indication only. The dispenser 100 provided with a cap 102 has no visible or tangible edges, no edge or rim, and no projecting surface. Said dispenser is held against the palm of one hand, in particular of an adult hand. The slight curvature of the fingers of the hand ensures that said dispenser is held firmly in the hand. The outer surface of the dispenser 100 is perfectly smooth against the palm of the hand which makes the rotation thereof when gripping easier. The use thereof, in particular when compressing the resiliently compressible body 101, is made easier.

The fact that the respective outer surfaces S1 and S2 of the wall 121 of the cap 102 and of the wall 101*a* of the resiliently compressible body 101 are flush also makes it possible to prevent the cap 102 from separating by accident from the body 101 for example when rubbed against a rough surface or against another object.

Preferably, the upper edge 105 of the resiliently compressible body 101 and the upper edge 104 of the cap 102 are in contact with one another when the cap 102 is attached to the resiliently compressible body 101.

As shown in connection with FIG. 3, the cap 102 of the dispenser 100 may be completely removed thus revealing a cover 106 provided in order to cover the dispensing device 114. Said cover has a shape identical to that of the cap 102, but substantially smaller by the thickness Ep of the wall 121 of the cap 102. When the cap 102 is removed, the dispenser 100 therefore retains overall its continuously convex form.

The cover 106 covering the dispensing device 114 is attached in the region of a throat 107 present on the resiliently compressible body 101, using known snap-on means 109. The cover 106 has an opening 110 in communication with an outlet aperture 111 of the dispensing device 114. The openings 110 and 111 allow the liquid product P to be dispensed. The surface of the cover 106 is flush with the outlet aperture 111 of the dispensing device 114 (FIG. 3).

The respective outer surfaces of the cover 106 and of the resiliently compressible body 101 are not flush. The outer surface S3 of the cover 106 is set back relative to that S2 of the resiliently compressible body 101, thus forming a shoulder 112 in the region of the throat 107. The shoulder 112 will advantageously have dimensions that are strictly complementary to the thickness Ep of the wall 121 of the cap 102.

The cover ensures a continuity of form with the body 101. Said cover defines a volume above the body where the dispensing device 114 is housed, the apertures 110 and 111 being flush with the apex thereof. This will be described in more detail below. Therefore, the body and the cover have no projecting roughness and no sharp edge, except for the upper edge 105, which is not very wide. Owing to its continuously convex form, the cover allows the product to be dispensed while moving the dispenser and causing the cover to slide on the surface of the skin. With existing dispensers, the product would be applied more locally.

In the embodiment shown in connection with FIG. 1, the dispenser 100 comprises a flexible pouch 113 which is arranged inside the resiliently compressible body 101 and which contains the liquid product P to be dispensed.

The resiliently compressible body 101 is intended to be deformed by manual pressure. Said resiliently compressible body is made of a resiliently deformable material and the walls thereof 101*a* may be compressed while being sufficiently resilient to recover their initial shape when the pressure ceases. Accordingly, the resiliently compressible body 101 is made of a rubber, elastomer or thermoplastics material. Good results have been obtained with a body made of a material from the polypropylene family with a hardness of between 60 and 80 Shore A, measured on the dispenser placed flat on its side. These values however are only an indication.

The dispensing device 114 is attached to the throat 107 of the resiliently deformable body 101 by a sealed attachment, for example by snapping on or by bonding. The dispensing device 114 allows the liquid to circulate from inside the pouch 113 up to the outlet aperture 111. Said dispensing device is in the form of a plunger tube, one end of which extends towards the bottom of the flexible pouch 113 and has an opening 115 in communication with the interior of the flexible pouch 113. At its other end, a nozzle 123 is attached, by bonding or by welding, provided with a slit 124 which creates the outlet aperture 111. The slit 124 allows a liquid to pass in one direction, in this case from the interior of the dispensing device 114 to the exterior.

The flexible pouch 113 containing the liquid product P is attached to a neck 122 present on the dispensing device 114, for example by means of a weld.

The space E between the resiliently compressible body 101 and the flexible pouch 113 is filled with air as the pouch is emptied of the product contained therein.

The throat 107 of the resiliently deformable body 101 is traversed by one or more apertures 125 allowing air to enter the space E comprised between the resiliently compressible body 101 and the flexible pouch 113. Facing each aperture 125 is a deformable washer 126 suitable for acting as a shutter and thus closing the corresponding outlet aperture when the user applies manual pressure to said resiliently deformable body 101. The washer or washers 126 are arranged against the wall of the throat 107 which faces the space E.

During use of the dispenser 100, the manual pressure applied to the resiliently compressible body 101 is transmitted to the flexible pouch 113 which contains the liquid product P. Said product then flows into the dispensing device 114, which opens the slit 124 of the nozzle 123 and causes the product P to be ejected through the outlet aperture 111. No air is allowed to enter the flexible pouch 113 through the slit 124. This characteristic guarantees the stability and preservation of the formulation of the liquid product. The compression applied to the resiliently compressible body 101 also has the effect of flattening the deformable washer or washers 126 against the aperture or apertures 125 and preventing air from leaving the space E through the apertures 125.

When the manual pressure applied to the walls 101*a* of the resiliently compressible body 101 ceases, the body relaxes, the slit 124 of the nozzle 123 closes and the deformable washers 126 deform so as no longer to seal the apertures 125. Air enters the space E between the resiliently compressible body 101 and the flexible pouch 113 through the apertures 125. The volume of air which thus enters the space E then compensates for the volume of product ejected from the flexible pouch 113. The resiliently compressible body 101 thus recovers its initial shape.

When the dispenser 100 is not in use, the cap 102 of the dispenser 100 seals the outlet aperture 111 present on the cover 106. Even if pressure is applied to the resiliently compressible body 101 by accident, the cap 102 prevents liquid product P from escaping.

The cap 102 is attached removably to the resiliently compressible body 101 using attachment means 118. Thus, the cap 102 can be separated completely from the resiliently compressible body 101.

The attachment means 118 intended to ensure the attachment of the cap 102 to the resiliently compressible body 101 are, for example, snap-on means. In the embodiment shown in FIG. 1, the attachment means 118 are such that the cover 106 has on its outer surface a hollow motif 119, such as a recessed housing, suitable for housing a motif in relief, such as a tongue 120 present on the inner peripheral surface of the wall 121 of the cap 102. In a variant of the invention these may be grooves present on the outer surface of the cover 106 suitable for housing projecting portions or ridges of complementary shape present on the inner surface of the wall 121 of the cap 102.

The compressible dispenser 100 according to the invention thus has characteristics that are both technical and aesthetic and which render said dispenser reliable and easy to use without requiring too complex an assembly of parts.

The invention claimed is:

1. A resiliently compressible dispenser of a liquid product of the type comprising:

a resiliently compressible body having a wall with upper edges, a dispensing device, of said liquid product having an outlet aperture for the liquid, a cap with a wall having upper edges, and attachment means intended to attach said cap removably to said body, wherein said resiliently compressible dispenser comprises a cover covering the dispensing device, the cover having an outer peripheral surface, in that the wall of the cap and the wall of the body have outer surfaces that are flush at the upper edges thereof, and in that the cap and the body are portions, complementary to one another, and continuously convex in form, said outer peripheral surface of the cover having a convex shape arranged parallel to and inside of a convex shape of the outer surface of the wall of the cap.

2. The dispenser according to claim 1, wherein said dispenser comprises a flexible pouch which is arranged inside said resiliently compressible body and which contains the liquid product, the interior of the flexible pouch being in direct communication with the outlet aperture.

3. The dispenser according to claim 1, wherein the attachment means are such that the cover has on its outer peripheral surface hollow motifs complementary to motifs in relief provided on an inner peripheral surface of the wall of the cap.

4. The dispenser according to claim 1, wherein the upper edges of said cap and the upper edges of said resiliently compressible body are in contact with one another when said cap is attached to said resiliently compressible body.

5. The dispenser according to claim 2, wherein the dispensing device is in the form of a plunger tube, one end of which extends towards the bottom of the flexible pouch and the other end of which comprises a nozzle provided with a slit creating the outlet aperture.

6. The dispenser according to claim 2, wherein the resiliently compressible body has a throat through which one or more openings are arranged which open into a space between the resiliently compressible body and the flexible pouch, a washer acting as a shutter being provided on each opening to prevent the air contained in said space from escaping when the user applies manual pressure to said resiliently compressible body.

7. The dispenser according to claim 1, wherein said dispenser has an ellipsoidal shape, an ovoid shape, a flattened ellipsoidal or a flattened ovoid shape.

* * * * *